US008018447B2

(12) United States Patent
Miyata et al.

(10) Patent No.: US 8,018,447 B2
(45) Date of Patent: Sep. 13, 2011

(54) SEMICONDUCTOR INTEGRATED CIRCUIT DEVICE AND DATA PROCESSOR SYSTEM

(75) Inventors: Shusaku Miyata, Tokyo (JP); Hirofumi Sonoyama, Tokyo (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 902 days.

(21) Appl. No.: 12/020,418

(22) Filed: Jan. 25, 2008

(65) Prior Publication Data

US 2008/0198148 A1 Aug. 21, 2008

(30) Foreign Application Priority Data

Feb. 16, 2007 (JP) ..... 2007-035693

(51) Int. Cl.
*G09G 5/00* (2006.01)
*G09G 3/36* (2006.01)

(52) U.S. Cl. ..... 345/204; 345/98

(58) Field of Classification Search ..... 345/98–100, 345/204, 211–213
See application file for complete search history.

(56) References Cited

U.S. PATENT DOCUMENTS 7,034,792 B2 4/2006 Tamura
7,668,989 B2 * 2/2010 Nonoyama et al. ..... 710/71
7,889,164 B2 * 2/2011 Ishii et al. ..... 345/87
2006/0103620 A1 5/2006 Joo et al.
2006/0267925 A1 * 11/2006 Sakamaki et al. ..... 345/104

FOREIGN PATENT DOCUMENTS

JP 2001-222249 A 8/2001
JP 2006-146220 A 6/2006

* cited by examiner

*Primary Examiner* — Jimmy H Nguyen
(74) *Attorney, Agent, or Firm* — Miles & Stockbridge P.C.

(57) ABSTRACT

To provide an input interface technique of display data which can contribute to improvement of reliability and high performance of a system in which a semiconductor integrated circuit device including a RAM and a display driver circuit is incorporated. A semiconductor integrated circuit device includes a first high-speed serial interface circuit which has one differential serial data channel and a second high-speed serial interface circuit which has a plurality of differential serial data channels, the first high-speed serial interface circuit performs interface with the outside for control information, and a control circuit performs an internal operation on the basis of the control information. Both of the high-speed serial interface circuits share a RAM for storage of display data information. Whether the data information to be supplied to the RAM is received by using the first high-speed serial interface circuit or the second high-speed serial interface circuit is determined by the control circuit in accordance with the control information that is input to the first high-speed serial interface circuit.

14 Claims, 3 Drawing Sheets

FIG. 3

TWO CHANNELS

PCLK: 1 2 3 4 5 6 7 8 9 10 11 12 13 14 15

16bit

| | | | | | | | | | | | | | | | |
|---|---|---|---|---|---|---|---|---|---|---|---|---|---|---|---|
| D0 | X | X | R4 | R3 | R2 | R1 | R0 | X | X | X | G5 | G4 | VS | Res | CP |
| D1 | G3 | G2 | G1 | G0 | X | X | B4 | B3 | B2 | B1 | B0 | X | HS | DE | RES |

18bit

| | | | | | | | | | | | | | | | |
|---|---|---|---|---|---|---|---|---|---|---|---|---|---|---|---|
| D0 | X | X | R5 | R4 | R3 | R2 | R1 | R0 | X | X | G5 | G4 | VS | Res | CP |
| D1 | G3 | G2 | G1 | G0 | X | X | B5 | B4 | B3 | B2 | B1 | B0 | HS | DE | RES |

24bit

| | | | | | | | | | | | | | | | |
|---|---|---|---|---|---|---|---|---|---|---|---|---|---|---|---|
| D0 | R7 | R6 | R5 | R4 | R3 | R2 | R1 | R0 | G7 | G6 | G5 | G4 | VS | Res | CP |
| D1 | G3 | G2 | G1 | G0 | B7 | B6 | B5 | B4 | B3 | B2 | B1 | B0 | HS | DE | RES |

FIG. 4

THREE CHANNELS

PCLK: 1 2 3 4 5 6 7 8 9 10

16bit

| | | | | | | | | | | |
|---|---|---|---|---|---|---|---|---|---|---|
| D0 | X | X | X | R4 | R3 | R2 | R1 | R0 | VS | CP |
| D1 | X | X | G5 | G4 | G3 | G2 | G1 | G0 | HS | Res |
| D2 | X | X | X | B4 | B3 | B2 | B1 | B0 | DE | Res |

18bit

| | | | | | | | | | | |
|---|---|---|---|---|---|---|---|---|---|---|
| D0 | X | X | R5 | R4 | R3 | R2 | R1 | R0 | VS | CP |
| D1 | X | X | G5 | G4 | G3 | G2 | G1 | G0 | HS | Res |
| D2 | X | X | B5 | B4 | B3 | B2 | B1 | B0 | DE | Res |

24bit

| | | | | | | | | | | |
|---|---|---|---|---|---|---|---|---|---|---|
| D0 | R7 | R6 | R5 | R4 | R3 | R2 | R1 | R0 | VS | CP |
| D1 | G7 | G6 | G5 | G4 | G3 | G2 | G1 | G0 | HS | Res |
| D2 | B7 | B6 | B5 | B4 | B3 | B2 | B1 | B0 | DE | Res |

SEMICONDUCTOR INTEGRATED CIRCUIT DEVICE AND DATA PROCESSOR SYSTEM

CROSS-REFERENCE TO RELATED APPLICATIONS

The disclosure of Japanese Patent Application No. 2007-35693 filed on Feb. 16, 2007 including the specification, drawings and abstract is incorporated herein by reference in its entirety.

BACKGROUND OF THE INVENTION

The present invention relates to an input interface technique of display data in a display driving control device or a semiconductor integrated circuit device having a RAM used as a frame buffer and a display driver circuit, and relates to a technique effective for application in a mobile communication terminal device such as a mobile phone.

A mobile communication terminal device such as a mobile phone is compatible with not only connection to the Internet, but also reception of terrestrial digital television broadcast, and it is necessary to realize high-speed data transfer of an increasing display data from a baseband unit to a display driving control device. Japanese Unexamined Patent Publication No. 2006-146220 discloses a mobile phone which employs a high-speed serial interface circuit for an interface circuit of a display driving control device coupled to a baseband unit. Japanese Unexamined Patent Publication No. 2001-222249 discloses a technique in which a high-speed serial interface circuit as well as a parallel interface circuit are provided, and still-image data from the parallel interface circuit and moving-image data from the high-speed serial interface circuit can be written into a RAM at the same time.

SUMMARY OF THE INVENTION

In terms of employing a plurality of high-speed serial interface circuits that are different in transfer processing capability from each other in a display driving control device, the inventors studied the followings. In a structure in which a display driving control device and a display device are mounted in a cover case that is foldably provided, through a hinge portion, to a main body case incorporating a baseband unit, it is possible to reduce a risk of undesired disconnection of lines that pass through the hinge portion, if the number of lines is small. If both the high-speed serial interface circuit and the parallel interface circuit are employed, the number of signal lines increases. In addition, when input of display image data is switched between a plurality of the high-speed serial interface circuits, image display is distorted at the time of switching unless timing of stopping the supplying of image data input to one high-speed serial interface circuit to a RAM is controlled in synchronization with timing of starting the supplying of the display data input to the other high-speed serial interface circuit to the RAM. In consideration of coupling one high-speed serial interface circuit to a host processor and coupling the other high-speed serial interface circuit to an accelerator of the host processor, it is necessary to find out, in order to improve the performance of the whole system, which interface circuit a command interface function is advantageously assigned to.

An object of the present invention is to provide an input interface technique of display data which can contribute to both improvement of reliability and high performance of a system in which a semiconductor integrated circuit device including a RAM and a display driver circuit is incorporated.

Another object of the present invention is to contribute to improvement of reliability and high performance of a data processor system including a display driving control device that is coupled to a host processor and an accelerator through different high-speed serial interface circuits.

Still another object of the present invention is to prevent distortion of image display when input of image data is switched between a plurality of high-speed serial interface circuits.

The above-described objects, the other objects, and novel characteristics of the present invention will become apparent with reference to the description and accompanying drawings of the present specification.

The followings are brief description of the representative outlines among the inventions disclosed in this application.

That is, a semiconductor integrated circuit device includes a first high-speed serial interface circuit which has one differential serial data channel and a second high-speed serial interface circuit which has a plurality of differential serial data channels, the first high-speed serial interface circuit performs command interface with the outside by using control information, and a control circuit performs an internal operation on the basis of the control information. Both of the high-speed serial interface circuits share a RAM for storage of display data information. Whether the first high-speed serial interface circuit or the second high-speed serial interface circuit is used when receiving the data information to be supplied to the RAM is determined by the control circuit in accordance with the control information that is input to the first high-speed serial interface circuit.

According to the above-described means, since the first and second high-speed serial interfaces are employed for external interfaces of display data information, the display data information can be supplied to the semiconductor integrated circuit device by using the small number of interface signal lines, and it is possible to reduce a risk of undesired disconnection of the interface signal lines coupled to the semiconductor integrated circuit device in a device in which the semiconductor integrated circuit device is incorporated. In terms of this point, it is possible to improve the reliability of the system.

Since the high-speed serial interfaces are employed for interfaces of control information and data information, a large amount of data transfer can be easily secured by using the small number of interface signal lines. In addition, a command interface function is not assigned to the second high-speed serial interface circuit that is relatively higher in data transfer capability. Accordingly, in a usage pattern in which the accelerator specific to a specific data process is coupled to the second high-speed serial interface circuit in order to reduce a load on the host processor, the second high-speed serial interface circuit can be committed to reception of a result of the specific data process. In terms of these points, it is possible to improve data processing performance as the whole system in which the semiconductor integrated circuit device is incorporated.

The followings are brief description of the representative outlines among the inventions disclosed in this application.

That is, it is possible to contribute to both improvement of reliability and high performance of a system in which a semiconductor integrated circuit device including a RAM and a display driver circuit is incorporated.

BRIEF DESCRIPTION OF THE DRAWINGS

FIG. 3 is a format diagram which exemplifies a transmission format of data information and strobe information for one pixel transmitted by the MVI circuit having two differential serial data channels; and FIG. 4 is a format diagram which exemplifies a transmission format of data information and strobe information for one pixel transmitted by the MVI circuit having three differential serial data channels.

DETAILED DESCRIPTION OF THE PREFERRED EMBODIMENTS

1. Representative Embodiments

Figure 1:
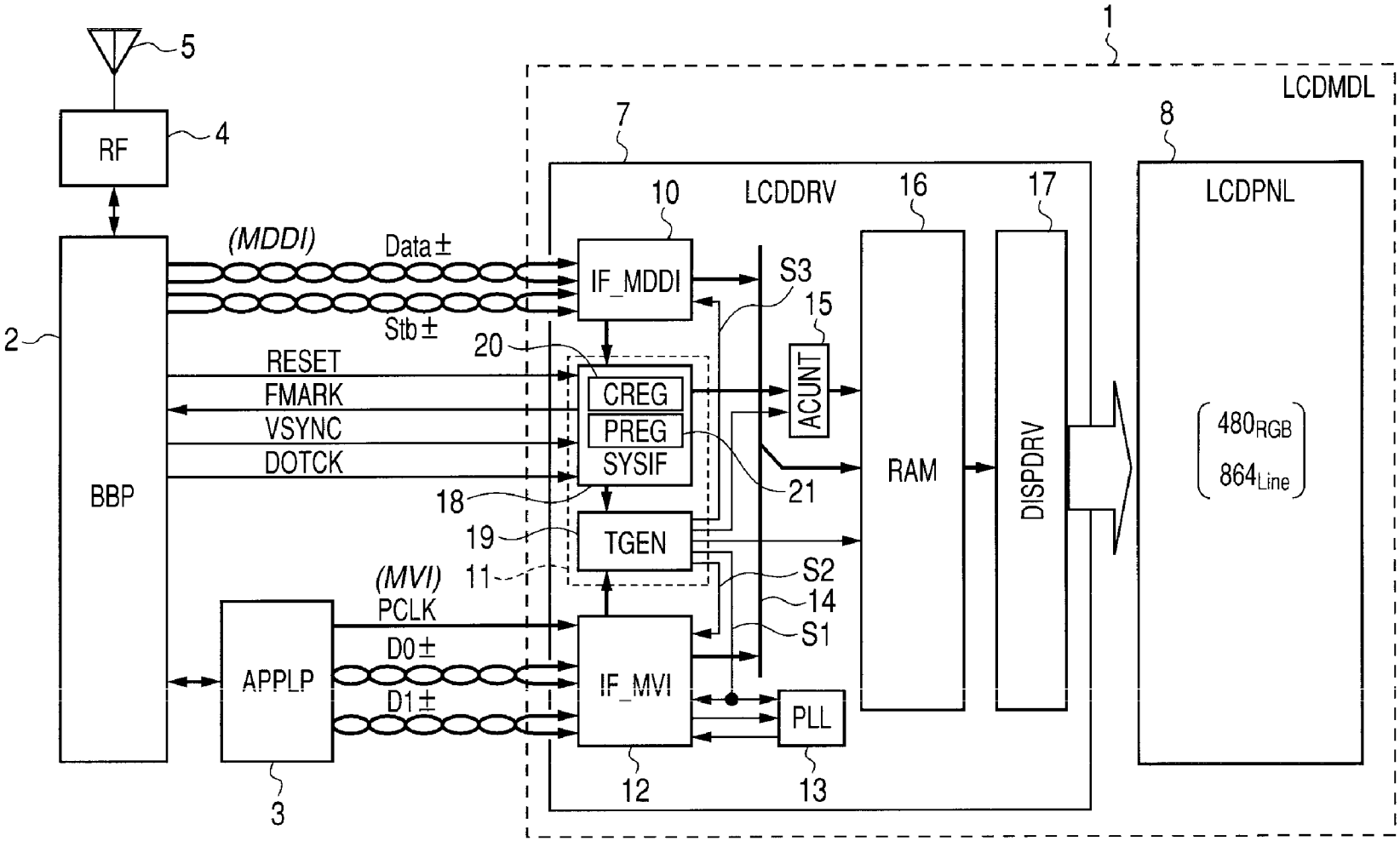
FIG. 1 is a block diagram which exemplifies a data processor system according to the present invention applied to a mobile phone.

First of all, the outlines of representative embodiments of the present invention disclosed in this application will be described. It should be noted that parenthetic reference numerals of the drawings which are referred to in the outlined description for the representative embodiments merely exemplify constituent elements included in the concept of the constituent elements to which the reference numerals are given.

[1] A semiconductor integrated circuit device (7) according to a representative embodiment of the present invention includes, a first high-speed serial interface circuit (10) which has one differential serial data channel, a second high-speed serial interface circuit (12) which has a plurality of differential serial data channels, a control circuit (11), a RAM (16), and a display driver circuit (17). Data information that is input to the first high-speed serial interface circuit from the outside and data information that is input to the second high-speed serial interface circuit from the outside can be supplied to the RAM. The display driver circuit generates a display driving signal on the basis of the data information read from the RAM. The control circuit controls an internal operation in accordance with control information that is input to the first high-speed serial interface circuit from the outside. Especially, whether the data information to be supplied to the RAM is received by using the first high-speed serial interface circuit or the second high-speed serial interface circuit is determined by the control circuit in accordance with the control information that is input to the first high-speed serial interface circuit.

According to the above-described means, since the first and second high-speed serial interfaces are employed for external interfaces of display data information, the display data information can be supplied to the semiconductor integrated circuit device by using the small number of interface signal lines, and it is possible to reduce a risk of undesired disconnection of the interface signal lines coupled to the semiconductor integrated circuit device in a system in which the semiconductor integrated circuit device is incorporated. In terms of this point, it is possible to improve the reliability of the system.

Since the high-speed serial interfaces are employed for interfaces of control information and data information, a large amount of data transfer can be easily secured by using the small number of interface signal lines. In addition, a command interface function using the control information is not assigned to the second high-speed serial interface circuit that is relatively higher in data transfer capability. Accordingly, in a usage pattern in which the accelerator specific to a specific data process is coupled to the second high-speed serial interface circuit in order to reduce a load on the host processor, the second high-speed serial interface circuit can be committed to reception of a result of the specific data process. In terms of these points, it is possible to improve data processing performance as the whole system in which the semiconductor integrated circuit device is incorporated.

As a concrete configuration of the present invention, the control circuit uses a first frame synchronization signal (VSYNC) input from an external terminal in a RAM operation for the data information that is input to the first high-speed serial interface circuit, and uses a second frame synchronization signal (VS) reproduced by using strobe information input from the second high-speed serial interface circuit in a RAM operation for the data information that is input to the second high-speed serial interface circuit. The first high-speed serial interface circuit is a mobile digital data interface (hereinafter, simply referred to as MDDI) circuit which inputs the data information and the control information in synchronization with a differential strobe signal. The second high-speed serial interface circuit is a mobile video interface (hereinafter, simply referred to as MVI) circuit which inputs the data information and the strobe information in synchronization with a clock signal.

As another concrete configuration of the present invention, when supplying the data information input to the first high-speed serial interface circuit to the RAM, the control circuit starts reproducing of the second frame synchronization signal in response to a switching instruction by the control information, and starts writing of the data information input to the second high-speed serial interface circuit into the RAM in synchronization with the second frame synchronization signal after writing of the data information for one frame in synchronization with the first frame synchronization signal is completed. Similarly, when supplying the data information input to the second high-speed serial interface circuit to the RAM, the control circuit starts writing of the data information input to the first high-speed serial interface circuit into the RAM in synchronization with the first frame synchronization signal after writing of the data information for one frame in synchronization with the second frame synchronization signal is completed in response to a switching instruction by the control information. Accordingly, timing of stopping the supplying of the data information input to one high-speed serial interface circuit to the RAM and timing of starting the supplying of the data information input to the other high-speed serial interface circuit to the RAM are not present in the middle of one frame. Thus, even if input of the data information to be stored into the RAM is switched, image display is not distorted.

[2] A data processor system according to a representative embodiment of the present invention includes a host processor (2), an accelerator (3) which is coupled to the host processor, a display driving control device (7) which is coupled to the host processor and the accelerator, and a display device (8) which is coupled to the display driving control device. The display driving control device includes a first high-speed serial interface circuit (10) which is coupled to the host processor and which has one differential serial data channel, a second high-speed serial interface circuit (12) which is coupled to the accelerator and which has a plurality of differential serial data channels, a control circuit (11), a RAM (16), and a display driver circuit (17). Data information that is input to the first high-speed serial interface circuit from the host processor and data information that is input to the second high-speed serial interface circuit from the accelerator can be supplied to the RAM. The display driver circuit generates a display driving signal on the basis of the data information read from the RAM to output to the display device. The control circuit controls an internal operation in accordance with control information that is input to the first high-speed serial interface circuit from the host processor. Especially, whether the data information to be supplied to the RAM is received by using the first high-speed serial interface circuit or the second high-speed serial interface circuit is determined by the control circuit in accordance with the control information that is input to the first high-speed serial interface circuit.

According to the above-described means, since the first and second high-speed serial interfaces are employed for external interfaces of display data information, the display data information can be supplied to the semiconductor integrated circuit device by using the small number of interface signal lines, and it is possible to reduce a risk of undesired disconnection of the interface signal lines coupled to the semiconductor integrated circuit device in a system in which the semiconductor integrated circuit device is incorporated. In terms of this point, it is possible to improve the reliability of the system.

Since the high-speed serial interfaces are employed for interfaces of control information and data information, a large amount of data transfer can be easily secured by using the small number of interface signal lines. In addition, a command interface function using the control information is not assigned to the second high-speed serial interface circuit that is relatively higher in data transfer capability. Accordingly, if the accelerator specific to a specific data process is coupled to the second high-speed serial interface circuit in order to reduce a load on the host processor, the second high-speed serial interface circuit can be committed to reception of a result of the specific data process. In terms of these points, it is possible to improve data processing performance in the data processor system.

2. Description of the Embodiments

Next, embodiments will be described in more detail.

A data processor system according to the present invention is exemplified in FIG. 1. The data processor system is applied to a mobile phone. In FIG. 1, there are representatively shown a liquid crystal display control module (LCDMDL) 1, a baseband processor (BBP) 2, an application processor (APPLP) 3, a radio frequency interface unit (RF) 4, and an antenna 5. The RF interface unit 4 performs analog processes such as modulation or demodulation and frequency up-conversion or frequency down-conversion of a transmission/reception signal. The baseband processor 2 performs channel codec or audio codec for mobile phone communications, and further performs a baseband process such as an OFDM (Orthogonal Frequency Division Multiplexing) demodulation process for a terrestrial digital broadcasting signal. In addition, the baseband processor 2 is configured as a host microcomputer that performs a reproducing process of audio data from an audio port (not shown) and an image process of photographing data from a camera port (not shown). Although not particularly limited, the baseband processor 2 is coupled to a key input unit through the other ports (not shown), and is coupled to a microphone and a speaker through an A/D converter and a D/A converter. The application processor 3 functions as an accelerator that performs a data process in accordance with a command issued from the baseband processor 2, and performs, for example, video decoding and audio decoding for transport stream data obtained by performing the OFDM demodulation process in the baseband processor 2. The baseband processor 2 and the application processor 3 are individually configured as semiconductor integrated circuit devices. It should be noted that the baseband processor 2 and the application processor 3 may be integrated into one semiconductor substrate (chip) so as to serve as one semiconductor integrated circuit device.

The baseband processor 2 performs host interface with the liquid crystal display control module 1 through an MDDI, and the application processor 3 performs high-speed interface with the liquid crystal display control module 1 through an MVI for moving image data or the like. The baseband processor 2 also executes interface with the liquid crystal display control module 1 through the MDDI for text data obtained when receiving a mail.

The liquid crystal display control module 1 includes a liquid crystal display driving control device (LCDDRV) 7 coupled to the baseband processor 2 and the application processor 3, and a liquid crystal display (LCDPNL) 8 coupled to the liquid crystal display driving control device 7. The liquid crystal display driving control device 7 is configured by using a technique of manufacturing a complementary MOS integrated circuit for one semiconductor substrate such as single-crystal silicon.

The liquid crystal display 8 includes, although not particularly limited to, a dot-matrix liquid crystal panel of 480×864 pixels, and has 480 source electrodes as signal electrodes and 864 gate electrodes as scanning electrodes. An image is displayed by driving the source electrodes using 480 pieces of image data for each scanning electrode in accordance with sequential drives of the scanning electrodes.

The liquid crystal display driving control device 7 includes an MDDI circuit (IF_MDDI) 10, a control circuit 11, an MVI circuit (IF_MVI) 12, a PLL circuit (PLL) 13, an internal data bus 14, an address counter circuit (ACUNT) 15, a RAM 16, and a liquid crystal driver circuit (DISPDRV) 17. The control circuit 11 includes a system interface circuit (SYSIF) 18 and a timing generator (TGEN) 19. The RAM 16 is used as a frame buffer, and has a write port and a read port separately. The address counter circuit 15 has a write address counter and a read address counter for the RAM 16 separately.

The MDDI circuit 10 is a circuit for performing high-speed serial interface with the baseband processor 2 by using a single differential serial data channel, and is coupled to a corresponding interface circuit of the baseband processor 2 through two differential data lines data± and two differential strobe signal lines Stb±. Data information such as image data and control information such as a command and a parameter are transmitted on the differential data lines data± in a predetermined format. The transmission on the differential data lines data± is in synchronization with a differential clock on the differential strobe signal lines Stb±. The control information received by the MDDI circuit 10 is supplied to the system interface circuit 18, and the data information is supplied to the internal data bus 14 in accordance with control of the timing generator 19.

The system interface circuit 18 includes a command register circuit (CREG) 20 and a parameter register circuit (PREG) 21. The command register circuit 20 has a plurality of command registers to each of which a unique address is assigned for each of control codes that specify respective operations and each of which holds the corresponding control code. The command registers hold the control codes by means of, for example, nonvolatile memory elements. The parameter register circuit 21 is a register circuit to which parameter information for specifying a window region to be set to the frame buffer can be set in a programmable manner and to which a unique address is assigned.

When instructing the liquid crystal display driving control device 7 to perform an operation, the baseband processor 2 supplies address information, as control information for instruction of a target command, to the MDDI circuit 10. Accordingly, the command register circuit 20 supplies the control code held by the command register specified by the address information, to the timing generator 19. The timing generator 19 generates an internal control signal in accordance with the control code to control internal operation timing such as access timing to the RAM 16 and display timing for the liquid crystal driver circuit 17.

The baseband processor 2 supplies to the MDDI circuit 10 data information for specifying, when specifying a window region for the frame buffer, the region, and address information of the parameter register circuit 21 into which the data information is stored. Accordingly, window region specifying information is set to a register in the parameter register circuit 21 specified by the address information. In a write access to a window region of the RAM 16, the beginning of the address of the window region is preset to the write address counter of the address counter circuit 15 in accordance with the window region specifying information set to the parameter register circuit 21, and an address increment operation of the write address counter is controlled in accordance with the end of the address and a region width. In a write access and a read access to the entire frame buffer of the RAM 16, an increment operation of the address counter circuit 15 starts from its initial value.

The system interface circuit 18 inputs therein a reset signal RESET, a vertical synchronization signal VSYNC, a dot clock signal DOTCK and the like, and outputs a frame mark signal FMARK. The vertical synchronization signal VSYNC is a signal regarded as a display frame synchronization signal of image data supplied to the MDDI circuit 10. As exemplified in FIG. 2, the MDDI circuit 10 receives image data for one frame in a period of two cycles of the vertical synchronization signal VSYNC from the baseband processor 2. The control circuit 11 writes the image data for one frame buffer received by the MDDI circuit 10 into the frame buffer in a period of two cycles of the vertical synchronization signal VSYNC (for example, in a period from time t0 to t2 in FIG. 2), reads twice the image data written into the frame buffer in a period of two cycles of the vertical synchronization signal VSYNC (for example, in periods from time t1 to t2 and from t3 to t4), and displays the image data twice. In this case, one period of displaying one frame corresponds to one cycle defined in 60 Hz cycle. Although not particularly limited, the increment operation of the address counter 15 in the write and read operations at this time is in synchronization with the internal dot clock DOTCK generated from change points of data± and Stb±. In the case where the liquid crystal display driving control device 7 outputs the frame mark signal FMARK to the baseband processor 2, the baseband processor 2 outputs the image data in synchronization with the cycle of the frame mark signal FMARK. In this case, the baseband processor 2 does not need to output the vertical synchronization signal VSYNC.

The MVI circuit 12 is a circuit for performing high-speed serial interface with the application processor 3 using a plurality of differential serial data channels. The MVI circuit 12 is coupled to a corresponding interface circuit of the application processor 3 through, for example, two differential data lines D0± of a first differential data channel, two differential data lines D1± of a second differential data channel, and a clock line PCLK. Data information such as moving image data and strobe information for frame synchronization are transmitted on the differential data lines D0± and Do± in a predetermined format. The transmission on the differential data lines D0± and Do± is in synchronization with a pixel clock signal on the clock line PCLK. The strobe information received by the MVI circuit 12 is supplied to the timing generator 19, and the data information is supplied to the internal data bus 14 in accordance with control of the timing generator 19. The PLL circuit 13 inputs therein the pixel clock signal transmitted through the clock line PCLK, and generates an internal clock that is in phase synchronization with the pixel clock signal. The generated internal clock serves as a dot clock used for increment of the address counter circuit 15.

A transmission format of the data information and the strobe information for one pixel transmitted by the MVI circuit 12 is exemplified in FIG. 3. FIG. 3 exemplifies 16 bits, 18 bits, and 24 bits of RGB data for one pixel. X represents indefinite, Ri represents pigment data of red, G represents pigment data of green, B represents pigment data of blue, VS represents a vertical synchronization strobe data bit, HS represents a horizontal synchronization strobe data bit, DE represents a data enable bit, CP represents a parity error bit, and RES represents a reset bit. The MVI circuit 12 converts the data information and the strobe information supplied in a predetermined transmission format into parallel data, and the parallel-converted strobe information is supplied to the timing generator 19. The vertical synchronization strobe data bit VS that is parallel-converted serves as a frame synchronization signal (hereinafter, also referred to as vertical synchronization signal VS). The parallel-converted data information is supplied to the internal data bus 14 in accordance with control of the timing generator 19, and is written into the RAM 16. The writing of the data information into the RAM 16 at this time is controlled to be in synchronization with the vertical synchronization signal VS, and the reading of the written data information is in synchronization with the vertical synchronization signal VS. Since the MVI circuit 12 has two differential serial data channels, the MVI circuit 12 receives the image data for one frame in a period of one cycle of the vertical synchronization signal VS from the application processor 3. The control circuit 11 writes the image data for one frame buffer received by the MVI circuit 12 into the frame buffer in a period of one cycle of the vertical synchronization signal VS (for example, in a period from time t7 to t9 in FIG. 2), reads once the image data written into the frame buffer in the same one cycle of the vertical synchronization signal VS (for example, in a period from time t8 to t10), and displays the image data once.

As described above, the MVI circuit 12 can realize a data transmission rate higher than that of the MDDI circuit 10. By paying attention to this, it is obvious that the MDDI circuit 10 is used for supplying image data of a still image or image data for window display of system information such as time and a reception status, and the MVI circuit 12 is used for supplying image data for moving image display by terrestrial digital broadcasting. When switching the input image data at this time, the control circuit 11 performs the switching while preventing the distortion of the display image. The switching control will be described.

Figure 2:
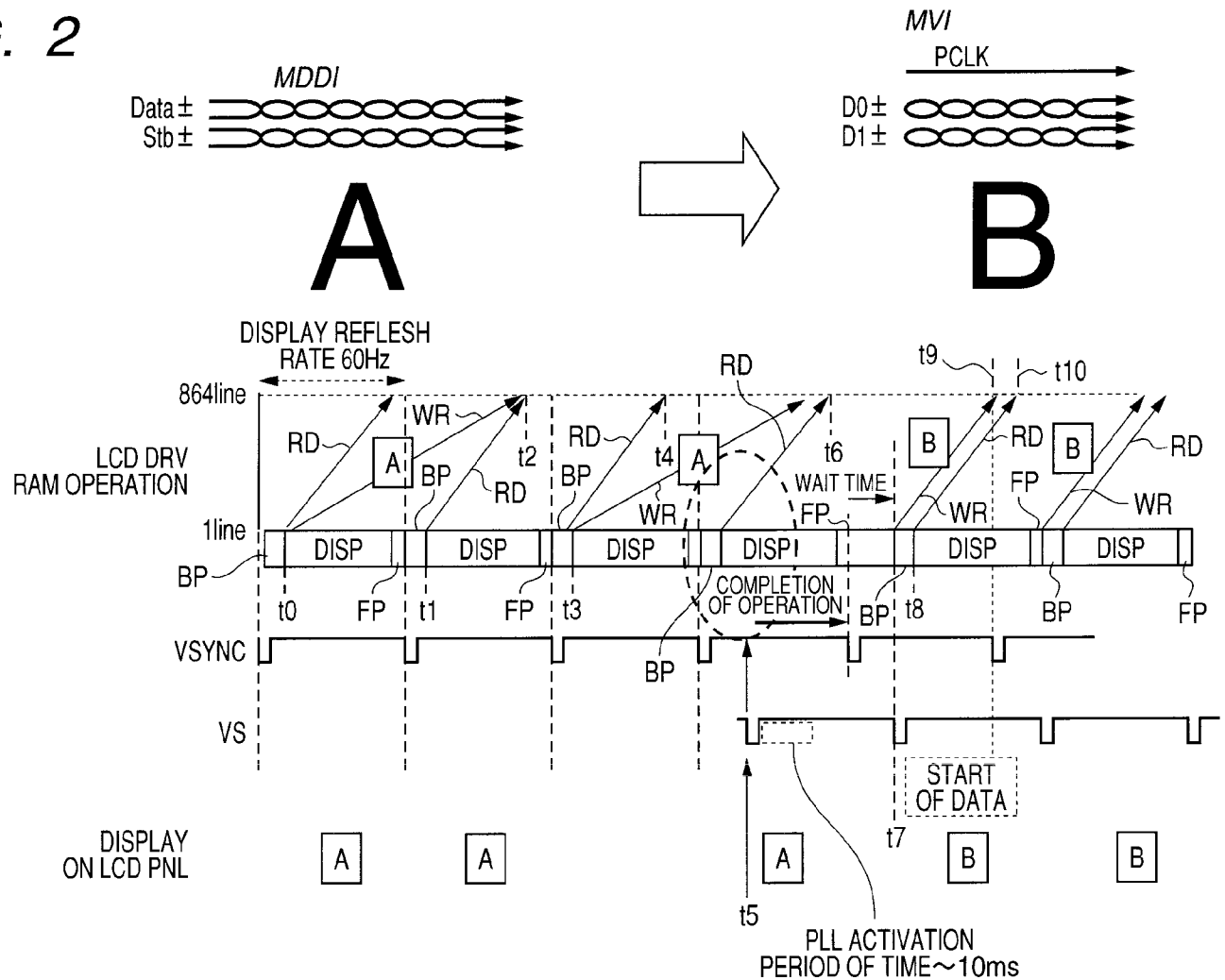
FIG. 2 is a timing chart in which when displaying image data received by an MDDI circuit, the display is switched to display of image data from an MVI circuit.

FIG. 2 shows a timing chart in which when displaying a character A by using image data received by the MDDI circuit 10, a character B is displayed by switching to display of image data from the MVI circuit 12. In FIG. 2, DISP represents a display period, FP represents a front porch (a blank period preceding Vsync), and BP represents a back porch (a blank period subsequent to Vsync).

Whether image data used for image display is to be received by the MDDI circuit 10 or the MVI circuit 12 is determined on the basis of the control information supplied to the command register circuit 20 through the MDDI circuit 10. To be brief, the MDDI circuit 10 performs command interface with the host.

The baseband processor 2 changes the vertical synchronization signal VSYNC to output image data for one frame to the MDDI circuit 10 in each two-cycle of the vertical synchronization signal VSYNC. The control circuit 11 writes the image data for one frame into the RAM 16 in two cycles of the vertical synchronization signal VSYNC, reads the written image data for one frame from the RAM 16 for each vertical synchronization signal VSYNC, and displays the image data on the liquid crystal display 8. When switching to display of the image data from the MVI circuit 12, the baseband processor 2 outputs first to the MDDI circuit 10 the control information for specifying a command for switching to display of the image data from the MVI circuit 12, and the command code is accordingly output to the timing generator 19 from the command register specified by the control information. In response to this, the timing generator 19 activates the PLL circuit 13 and the MVI circuit 12 by using a control signal S1 (time t5). The MVI circuit 12 supplies to the timing generator 19 the vertical synchronization signal VS obtained from the strobe information supplied from the application processor 3. The timing generator 19 continues the display control for the image data from the MDDI circuit 10 that is already executed at the time of the activation instruction issued by using the control signal S1, and completes the display of the image data for one frame (time t6). Along with this, when detecting the elapse of one cycle of the supplied vertical synchronization signal VS (time t7), the timing generator 19 supplies a control signal S2 to the MVI circuit 12, and starts the control of writing the data information received by the MVI circuit 12 from the application processor 3 into the frame buffer of the RAM 16 and the control of reading the image data written into the frame buffer for display. The writing starts in synchronization with the beginning of the cycle of the vertical synchronization signal VS, and the reading starts from the back of the back porch BP. Thereafter, the image data can be rewritten and displayed for each cycle of the vertical synchronization signal VS. When switching the image data, after the display of the image data A that is already displayed is completed for one frame, the image data is switched. Thus, there is no possibility of distortion of image display during the switching.

Although a timing chart is not especially illustrated, the same control is performed even for a case in which when displaying the image data received by the MVI circuit 12, the display is switched to display of the image data from the MDDI circuit 10. Specifically, the MVI circuit 12 receives image data from the application processor 3, writes the image data for one frame into the frame buffer in each cycle of the vertical synchronization signal VS, and reads the written image data for one frame for display. At this time, the baseband processor 2 outputs to the MDDI circuit 10 the control information for specifying a command for switching to display of the image data from the MDDI circuit 10, and the command code is accordingly output to the timing generator 19 from the command register specified by the control information. The timing generator 19 continues the display control for the image data from the MVI circuit 12 that is already executed, and completes the display of the image data for one frame. When completing the display, the timing generator 19 detects the elapse of one cycle of the vertical synchronization signal VSYNC supplied from the baseband processor 2, then supplies a control signal S3 to the MDDI circuit 10, and starts the control of writing the data information received by the MDDI circuit 10 from the baseband processor 2 into the frame buffer of the RAM 16 and the control of reading the image data written into the frame buffer for display. Also in this case, when switching the image data, after the display of the image data that is already displayed is completed for one frame, the image data is switched. Thus, there is no possibility of distortion of image display during the switching.

According to the data processor system described above, the following operational effects can be obtained.

[1] Since the MDDI circuit 10 and the MVI circuit 12, each having the differential serial data channel(s), are employed for external interfaces of display data information, the display data information can be supplied to the liquid crystal display driving control device 7 from the baseband processor 2 and the application processor 3 by using the small number of interface signal lines, and it is possible to reduce a risk of undesired disconnection of the interface signal lines coupled to the liquid crystal display driving control device 7 in the data processor system such as a mobile phone in which the liquid crystal display driving control device 7 is incorporated. In terms of this point, it is possible to improve the reliability of the data processor system.

[2] Since the MDDI circuit 10 and the MVI circuit 12, each having the differential serial data channel(s), are employed for interfaces of control information and data information, a large amount of data transfer can be easily secured by using the small number of interface signal lines. In addition, a command interface function using the control information is not assigned to the MVI circuit 12 that is relatively higher in data transfer capability. Accordingly, in a usage pattern in which the application processor 3 as an accelerator specific to a decode process of a terrestrial digital broadcasting signal is coupled to the MVI circuit 12 in order to reduce a load on the baseband processor 2, the MVI circuit 12 can be committed to reception of a result of the decode process. In terms of these points, it is possible to improve data processing performance as the whole data processor system in which the liquid crystal display driving control device 7 is incorporated.

[3] When input of image data to be stored into the frame buffer is switched between the MDDI circuit 10 and the MVI circuit 12, display of the image data that is already displayed when switching is completed for one frame, and then the image data stored into the frame buffer is switched. Thus, there is no possibility of distortion of the image display during the switching. Especially, since there is employed a control method in which when display of the image data that is already displayed is completed for one frame, the image data is switched in synchronization with a frame synchronization signal of a new display target, the control logic can be relatively easily realized.

The invention achieved by the inventors has been concretely described based on the embodiments, but is not limited to the embodiments. It is obvious that the invention can be variously changed in a range without departing from the gist of the invention.

For example, the MVI circuit may be provided with two or more differential serial data channels. For example, in the case of three channels, an information transmission format per one pixel is exemplified as in FIG. 4. Also in FIG. 4, 16 bits, 18 bits, and 24 bits of RGB data for one pixel are exemplified, as similar to FIG. 3. The command interface with the host device is not limited to the configuration of the command register 20 in which the command code is output from the command register selected on the basis of address information, but the host device may directly issue the command code. The high-speed serial interface circuits having the differential serial data channels are not limited to the MDDI circuit and the MVI circuit, but may be high-speed serial interface circuits with the other constitutional names. The display size controlled for display by the liquid crystal display driving control device can be appropriately changed. The present invention is not limited to a mobile phone, but can be widely applied to the other mobile information terminal devices such as PDAs and the other electronic devices.

What is claimed is:

1. A semiconductor integrated circuit device comprising:

a first high-speed serial interface circuit which has one differential serial data channel;

a second high-speed serial interface circuit which has a plurality of differential serial data channels;

a control circuit which controls an internal operation in accordance with control information that is input to the first high-speed serial interface circuit from the outside;

a RAM to which data information that is input to the first high-speed serial interface circuit from the outside and data information that is input to the second high-speed serial interface circuit from the outside can be supplied; and a display driver circuit which generates a display driving signal on the basis of the data information read from the RAM, wherein whether the first high-speed serial interface circuit or the second high-speed serial interface circuit is used when receiving the data information to be supplied to the RAM is determined by the control circuit in accordance with the control information that is input to the first high-speed serial interface circuit.

2. The semiconductor integrated circuit device according to claim 1, wherein the control circuit uses a first frame synchronization signal input from an external terminal in a RAM operation for the data information that is input to the first high-speed serial interface circuit, and uses a second frame synchronization signal reproduced by using strobe information in a RAM operation for the data information that is input to the second high-speed serial interface circuit, the strobe information being input from the second high-speed serial interface circuit.

3. The semiconductor integrated circuit device according to claim 2, wherein the first high-speed serial interface circuit is a mobile digital data interface circuit which inputs the data information and the control information in synchronization with a differential strobe signal.

4. The semiconductor integrated circuit device according to claim 3, wherein the second high-speed serial interface circuit is a mobile video interface circuit which inputs the data information and the strobe information in synchronization with a clock signal.

5. The semiconductor integrated circuit device according to claim 2, wherein when supplying the data information input to the first high-speed serial interface circuit to the RAM, the control circuit starts reproducing of the second frame synchronization signal in response to a switching instruction by the control information, and starts writing of the data information input to the second high-speed serial interface circuit into the RAM in synchronization with the second frame synchronization signal after writing of the data information for one frame in synchronization with the first frame synchronization signal is completed.

6. The semiconductor integrated circuit device according to claim 5, wherein when supplying the data information input to the second high-speed serial interface circuit to the RAM, the control circuit starts writing of the data information input to the first high-speed serial interface circuit into the RAM in synchronization with the first frame synchronization signal after writing of the data information for one frame in synchronization with the second frame synchronization signal is completed in response to a switching instruction by the control information.

7. A data processor system comprising:

a host processor;

an accelerator which is coupled to the host processor;

a display driving control device which is coupled to the host processor and the accelerator; and a display device which is coupled to the display driving control device, wherein the display driving control device including:

a first high-speed serial interface circuit which is coupled to the host processor and which has one differential serial data channel;

a second high-speed serial interface circuit which is coupled to the accelerator and which has a plurality of differential serial data channels;

a control circuit which controls an internal operation in accordance with control information that is input to the first high-speed serial interface circuit from the host processor;

a RAM to which data information that is input to the first high-speed serial interface circuit from the host processor and data information that is input to the second high-speed serial interface circuit from the accelerator can be supplied; and a display driver circuit which generates a display driving signal on the basis of the data information read from the RAM to output to the display device, wherein whether the first high-speed serial interface circuit or the second high-speed serial interface circuit is used when receiving the data information to be supplied to the RAM is determined by the control circuit in accordance with the control information that is input to the first high-speed serial interface circuit.

8. The data processor system according to claim 7, wherein the host processor is a baseband processor which is coupled to a high-frequency circuit, and the accelerator is a microcomputer which executes a command issued from the baseband processor.

9. The data processor system according to claim 8 mounted in a mobile communication terminal device.

10. The data processor system according to claim 7, wherein the control circuit uses a first frame synchronization signal input from the host processor in a RAM operation for the data information that is input to the first high-speed serial interface circuit, and uses a second frame synchronization signal reproduced by using strobe information in a RAM operation for the data information that is input to the second high-speed serial interface circuit, the strobe information being input from the accelerator.

11. The data processor system according to claim 10, wherein the first high-speed serial interface circuit is a mobile digital data interface circuit which inputs the data information and the control information in synchronization with a differential strobe signal.

12. The data processor system according to claim 11, wherein the second high-speed serial interface circuit is a mobile video interface circuit which inputs the data information and the strobe information in synchronization with a clock signal.

13. The data processor system according to claim 7, wherein when supplying the data information input to the first high-speed serial interface circuit to the RAM, the control circuit starts reproducing of the second frame synchronization signal in response to a switching instruction by the control information, and starts writing of the data information input to the second high-speed serial interface circuit into the RAM in synchronization with the second frame synchronization signal after writing of the data information for one frame in synchronization with the first frame synchronization signal is completed.

14. The data processor system according to claim 13, wherein when supplying the data information input to the second high-speed serial interface circuit to the RAM, the control circuit starts writing of the data information input to the first high-speed serial interface circuit into the RAM in synchronization with the first frame synchronization signal after writing of the data information for one frame in synchronization with the second frame synchronization signal is completed in response to a switching instruction by the control information.

* * * * *